United States Patent [19]

Charlton

[11] 4,229,746

[45] Oct. 21, 1980

[54] LOOP COUPLER COMMUTATING FEED FOR SCANNING A CIRCULAR ARRAY ANTENNA

[75] Inventor: Gregory G. Charlton, Reseda, Calif.

[73] Assignee: International Telephone and Telegraph Corporation, New York, N.Y.

[21] Appl. No.: 77,850

[22] Filed: Sep. 21, 1979

[51] Int. Cl.[3] ..... H01Q 3/24; H01Q 3/32

[52] U.S. Cl. ..... 343/854; 333/107

[58] Field of Search ..... 333/106, 107; 343/876, 343/853, 854

[56] References Cited

U.S. PATENT DOCUMENTS

| | | | |
|---|---|---|---|
| 2,477,635 | 8/1949 | Marchand | 333/107 |
| 3,066,291 | 11/1962 | Alford | 343/876 |

*Primary Examiner*—Eli Lieberman

*Attorney, Agent, or Firm*—William T. O'Neil

[57] ABSTRACT

A multiple port loop-coupler, commutating feed for a circular or cylindrical array. A rotor having a plurality of elongated coupling loops circumferentially spaced about an arc of its perimeter is fed from a strip line configuration excited at the driven central axis of the rotor. A plurality of elongated stater loops within essentially the same radial dimensions but extending throughout the full 360 degrees of the circular perimeter of the device continuously couples a changing fraction of the stater loops to the rotor as the latter is rotated. An output port is provided connected to each stater loop, and these output ports may then be discreetly connected to corresponding elements of a circular array or columns of elements of a cylindrical array.

12 Claims, 7 Drawing Figures

LOOP COUPLER COMMUTATING FEED FOR SCANNING A CIRCULAR ARRAY ANTENNA

BACKGROUND OF THE INVENTION

1. Field of the Invention

The invention relates to radar systems generally, and more particularly to systems for generating continuous 360 degree rotation of a beam.

2. Description of the Prior Art

The form of a cylindrical antenna to which the present invention might be applied to variously described in the patent and other technical literature. For example U.S. Pat. No. 3,474,446 describes an array of microwave radiators in vercial columns about a circular perimeter forming a cylinder. Another prior art device is described in U.S. Pat. No. 3,653,057. Both of those patents involve electronic scanning means, and the said U.S. Pat. No. 3,653,057 involves electronic scanning or pointing of a beam about 360 degrees of azimuth.

Electronically-scanned, cylindrical array antennas are advantageous for applications where azimuth scan of the full 360 degrees is required and where the characteristics of the beam must remain substantially unchanged over this full range of azimuth angles.

Electronic scanning of a set of three or more prior art appropriately oriented planar phased arrays can provide wide angle coverage in aximuth but results in beam distortions, (i.e., beam characteristics are not uniform with angle). Morever such arrangements are quite expensive and uneconomical of available space.

Mechanically rotating antennas provide the required beam characteristic but usually do not have the required data rate. Furthermore the prime power requirement is much higher and the life-cycle costs tend to be greater as compared to electronic scanning systems due to the relatively large motor drive and its servicing.

Existing all-electronic cylindrical arrays also have disadvantages. In a practical configuration, they require many active sub-assemblies with an unacceptably large amount of loss and require frequent maintenance to avoid anomalous beam characteristics due to failures among the many components and sub-assemblies. Morever, variations in sub-assembly characteristics, due to component tolerances and differences, may cause variations in the beam characteristics as a function of azimuth angle. Although such variations may be relatively small, they can be important in certain exacting situations.

An existing electro-mechanical commutating feed known in the art as the Wullenweber Cylindrical Array Feed has the desired low drive power and high reliability since it uses a low-inertia mechanically rotating feed. In that design, however, power is capacitively coupled from rotor to stator transmission lines which in turn connect to the larger cylindrical array elements. It is known that such capacitive coupling causes a relatively large power loss and flutter or fluctuations in the radiated beam with rotational angle.

The manner in which the present invention incorporates the mechanical advantages of the Wullenweber device while greatly improving upon its power transfer and flutter characteristics will be seen as this description proceeds.

SUMMARY OF THE INVENTION

The present invention provides a commutating feed with a plurality of output ports each intended for discrete connection to corresponding elements or columns of a circular or cylindrical array to provide continuous 360 degree scan of a substantially uniform beam in space. The stator includes a plurality of fixed loops elongated in the radial direction within an annular cavity. Each stator loop is coupled to an output port, and a rotor assembly rotates in a plane substantially parallel to the plane of the adjacent elongated legs of the stator loops. The rotor assembly includes a plurality of similarly radially elongated rotor loops circumferentially disposed in radial correspondence with the aforementioned stator loops. The rotor loops cover an arc of the rotor circle normally not exceeding 180 degrees and ordinarily over an angle somewhat less. A central axle or torque tube provides for mechanical drive of the rotor assembly which, in addition to the aforementioned rotor loops, includes a feed transmission line assembly preferably of the strip line type. All rotor loops are fed from a central rotary joint and feed arrangement associated with the torque tube drive. The individual strip line center conductors associated with the corresponding rotor loops may be tailored as to path length in order to provide a predetermined distribution of phases across the arc of the rotor loops which will result in the proper phase excitation of the array elements or columns of elements excited at any one time as a result of coupling between the rotor and stator loops.

The rotor loop assembly is enclosed within the same annular cavity which includes the stator loops, the cavity being electrically closed by the provision of choke sections where the rotating assembly is in juxaposition with the annular civity fixed enclosure elements.

It is desirable for either the rotor or stator loops to be relatively wide measured circumferentially and the other set to be relatively narrow in the same dimension. This operates to greatly reduce flutter problems. If the narrower loops are employed as a rotor loops, the rotational inertia of the rotor assembly is minimized.

The details of a typical embodiment employing the principles of the invention will be described hereinafter.

DESCRIPTION OF THE PREFERRED EMBODIMENT

Figure 1C:
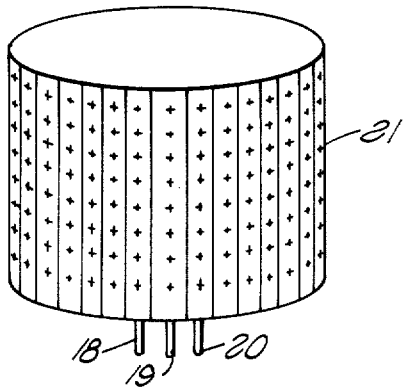
FIG. 1C is a representation of a typical cylindrical array with which the present invention may be used.
Figure 1A:
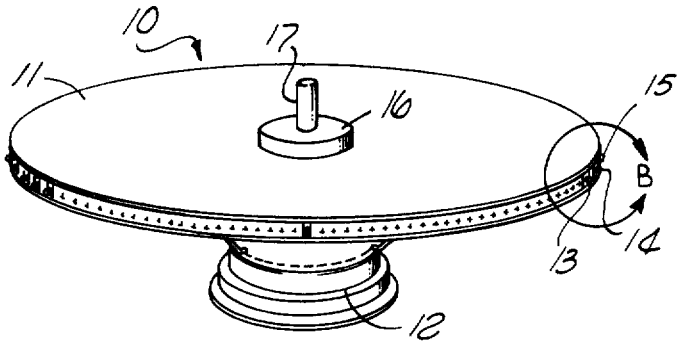
FIG. 1A is an overal pictoral view of a typical embodiment of the invention.

Referring now to FIG. 1A, the typical configuration of the device according to the invention is presented generally at 10. A base 12 would be expected to include a mechanical drive mechanism which would rotate the shaft or torque tube 17 to rotate the rotor assembly inside the device generally under the cover plate 11. An arbitrarily large number of output ports, illustrated as coaxial connectors are provided around the perimeter of the device, typically 13, 14 and 15. These will be more clearly evident in connection with the description of other figures herewith.

Figure 1B:
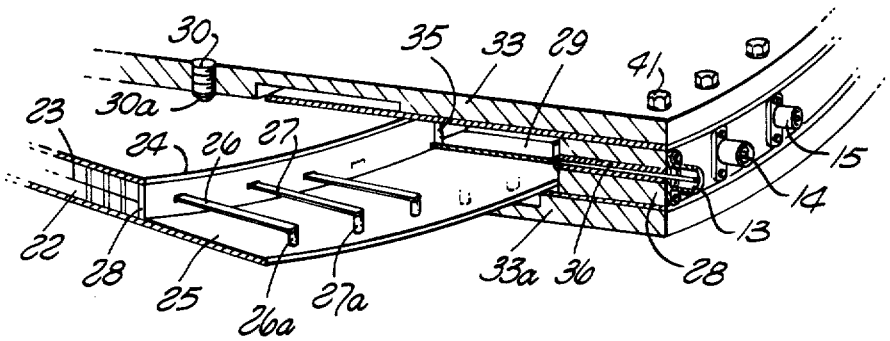
FIG. 1B is a partially sectioned pictorial view taken as shown in FIG. 1A depicting the internal construction of a portion of the device of FIG. 1A.

Before proceeding to the description of FIG. 1B, it may be helpful to note from FIG. 1C that a cylindrical array comprising a plurality of columns of elements distributed about a circle is generally depicted at 21. As hereinbefore indicated, such cylindrical arrays are known. It is to be assumed that each of the vertical columns or radiators is fed from a port, preferably of a coaxial type, such as at 18, 19 and 20. Each such port is connected from a corresponding port about the perimeter of the commutating feed device of FIG. 1A. For example, array ports 18, 19 and 20 would be connected from feed ports 13, 14 and 15 respectively.

Referring now to FIG. 1B, the ports 13, 14 and 15 are further identified. Port 13 for example connects through a coaxial lead 36 of arbitrary length to the end of one leg 29 of its corresponding stator loop.

The stator loop leg 29 is supported from the coax lead 36 and a conductive post 35, plate 33 completing the current path to the coax port 13 outer conductor. This structure will be more fully appreciated from the description of FIG. 3 hereinafter. A conductive cavity is essentially formed about the rotor and stator conductive loops, and is bounded by conductive plates 33 and **33*a*** and the action of a pair of annular choke cavities which will be more fully explained as this description proceeds.

In FIG. 1B the parts of the rotor assembly which are visible are the strip line structure comprising the two parallel conductive planes 24 and 25 with the individual center conductors, particularly 23, suspended within a dielectric material 22. The typical center conductors, for example 23 are discrete, the said conductor 23 being mechanically and electrically attached only to rotor loop leg 26. Rotor loop leg 26 is in turn supported from a conductive post **26*a* and the bottom plate 25 of the strip line assembly as extended beyond the dielectric bulkhead 28 to form a return path for the loop 26**.

The conductive outer planes of the strip line assembly namely 24 and 25 provide surfaces against which ball-type guide bearings **30*a* and 34*a* (the former seen in FIG. 1B and FIG. 3 and the latter seen in FIG. 3 only) serve to guide and center the rotor assembly in the vertical plane as it rotates. A cylindrical holder 30 for the bearing ball 30*a* preferably contains a compression spring urging the ball 30*a* against the surface 24. Likewise cylindrical holder 34 would also contain a compression spring urging the ball 34*a* against the surface 25**.

Figure 2:
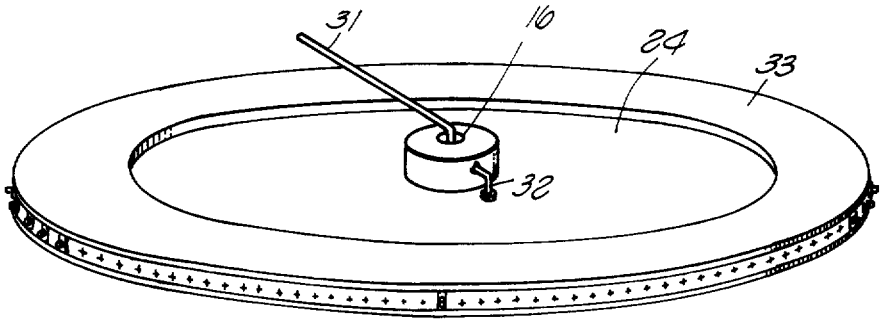
FIG. 2 is a pictorial view of a portion of FIG. 1A with the top cover plate removed.

In FIG. 2, the common or collector feed line 31 may be understood to be of the coaxial or wave guide type operating with the rotary joint 16 so that 31 is fixed while 32 rotates about with the rotor assembly 24.

Figure 3:
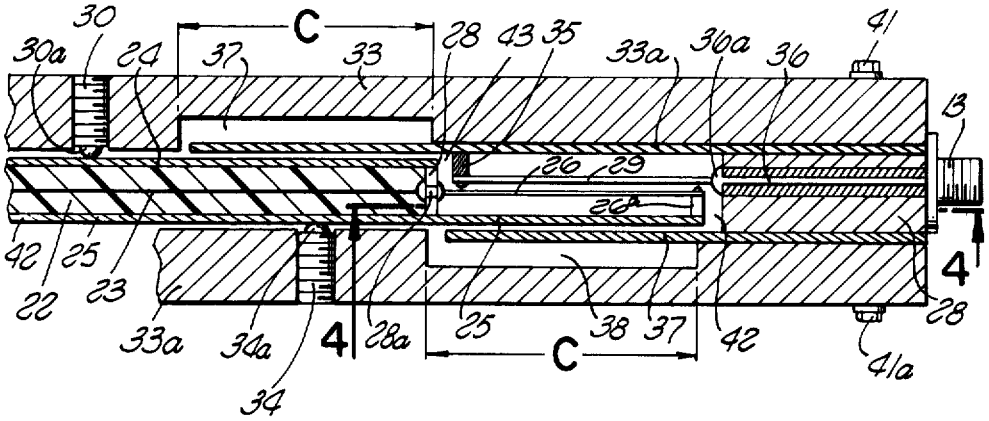
FIG. 3 is a further detail taken from FIG. 1B and illustrating the construction of the device of the invention more fully.

Referring now to FIG. 3, a sectional view is depicted as taken radially through the outward portion of FIG. 1A or FIG. 2. This section resembles FIG. 1B except that FIG. 1B might more correctly be characterized as a partially section pictoral view.

It will be noted from FIG. 3 that the metallic housing parts generally comprising the so-called annulus include the top plate 33 the bottom plate **33*a* and the coaxial port support block 28. Bolts, typically 41, are illustrated, and it will be seen that 41 and its counterpart 41*a*, operate to join those top and bottom plates to the aforementioned ring (coaxial port support block) 28 for mechanical ridgidity. A non-moving portion of 33*a* provides an annular ring and overlaps beyond the strip line assembly and sandwiches between 24 and 33, adjacent to choke cavity 37. This ring 33*a*, as extended, has a rotor counter-part at 25 where this is extended as indicated. Plate 33*a* provides the stator loop return circuit in essentially the same manner that 25** provides the return circuit for rotor loops.

A pair of choke cavities 37 and 38 each have a radial dimension C which is one quarter wave length at the operating frequency or operating center frequency. Each of these dimensions "C" is to be understood to be an electrical quarter wavelength resulting in a microwave energy short circuit at points 43 and 42 respectively. The result is the creation of an electrically closed cavity within the annulus structure, the said closed cavity encompassing both stator and rotor loops.

Figure 4:
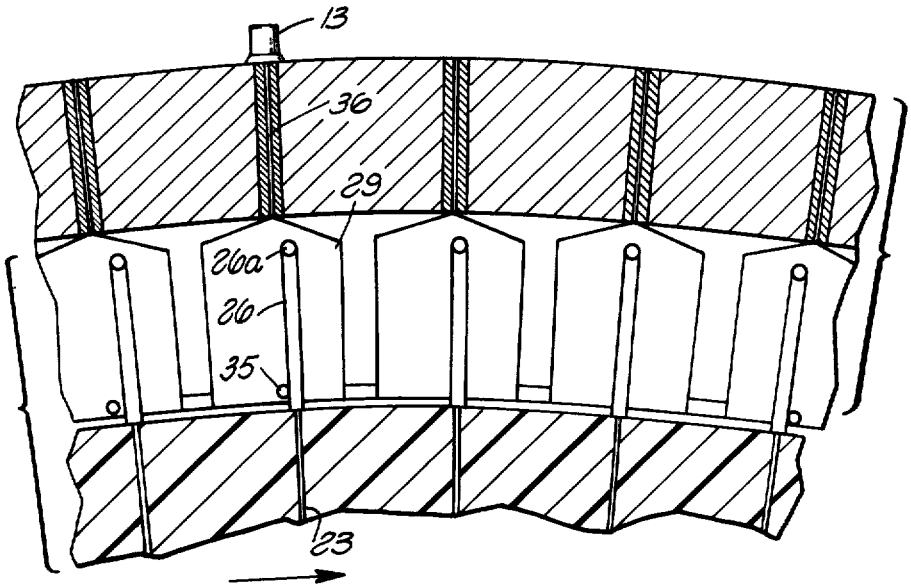
FIG. 4 is a planned view of the rotor and stator loop relationships in the device.

Referring now to FIG. 4, an upward looking view of a portion of the annulus is depicted as taken along the corresponding sectioning line of FIG. 3. Visible are the are the outlines of the strip line center conductors such as 23, the rotor loops typically 26 with their conductive support posts **26*a* and the wider stator loops (typically 29) with their conductive support posts are visible in outline (typically 35). A corresponding coaxial port 13 with its coaxial lead 36 leading to a connection substantially to the center of the chamfered end of 29 is depicted in FIG. 4**.

Figure 5:
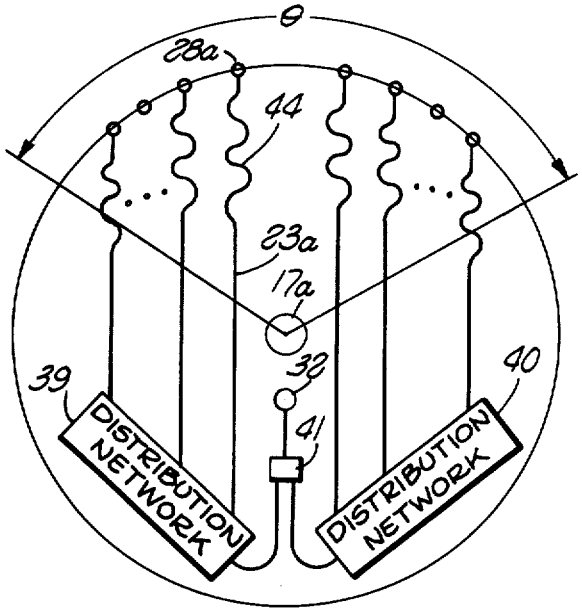
FIG. 5 is a schematic block diagram illustrating a typical rotor loop feed configuration.

Referring now to FIG. 5, a configuration for feeding the rotor loops at typical point **28*a* (of FIG. 3) is illustrated. In FIG. 5 it has beeen arbitrarily assumed that the angle $\theta$ is the arc of the array elements (FIG. 1A) energized at any one time. The number of rotor loop connections equivalent to 28*a* is of course equal to the number of such rotor loops over an angle or arc equal to $\theta$ about the rotor assembly 24 (FIG. 2) or as depicted on FIG. 1B**.

In FIG. 5, point **17*a* is the center of rotation of the shaft or torque tube 17 illustrated in FIG. 1A, and point 32 is representative of the transmission line from the rotary joint 16 (of FIG. 2). The entire assembly represented in FIG. 5 would rotate as a portion of the rotor assembly, the remainder of the rotor assembly of course being the annular portion including the rotor loop. From the common port at 32, a power divider/combiner 41 is fed directly and has two equal power outputs connected one to each of the two distribution networks 39 and 40. These distribution networks are of themselves divider/combiner devices providing the appropriate number of combining/dividing ports each of which feeds a stripline conductor as 23*a* and subsequently a corresponding rotor loop . It is to be understood that the stripline center conductor 23*a* may have a meandering segment 44, and that this segment has a predetermined length and therefore a corresponding phase delay property such that the corresponding rotor loops are all fed in a phase relationship which results in a pattern of relative phases at the output terminals of the overall device, for example 13, 14 and 15 which would in turn, result in the proper phase exitation over the arc $\theta$ of the corresponding array columns of elements (see FIG. 1C**).

Those portions of the apparatus of FIG. 5 including **23*a*, 44 and the corresponding parts relating to other rotor loops are readily accomplished in the stripline medium of the rotor assembly. Similarly, networks 39, 40 and the combiner/divider 41** can be accomplished, or may be instrumented separately in waveguide, microstrip or the like.

Modifications and variations will suggest themselves to those of skill in this art, and accordingly, it is not intended that the scope of the invention be limited to the drawings and this description, these being intended as typical and illustrative only.

What is claimed is:

1. A loop coupler commutating feed for a scanning circular array, comprising:

a stator assembly having a conductive bodymember in the general shape of an annulus having a cavity therein such that the cross-section of said annulus is generally U-shaped opening radially inward, said stator assembly also comprising a plurality of circumferentially distributed stator loops and each radially elongated within said cavity, each of said stator loops having its elongated leg current paths in a radially extending plane normal to the plane of said annulus;

a rotor assembly including a generally circular, conductive disc rotatable about its center, said center being substantially coincident with the geometric center of said annulus, said rotor assembly also including a plurality of rotor loops circumferentially spaced about an arcuate portion of the radially outward surface of said disc, said rotor loops also being radially elongated and each having its elongated leg current paths radial and in radially extending plane normal to the plane of said disc, the plant of said disc being substantially parallel to a plane through said annulus normal to the axis through the center of said annulus, said disc extending radially into said cavity such that said rotor loops couple to an arc of said stator loops in juxtaposition with said rotor loops about said arcuate portion of said disc, said coupling effecting energy transfer between said rotor and stator loops to a changing arcuate portion of said stator loops as said disc is rotated;

first means for providing RF drive to said rotor loops according to a predetermined phase distribution pattern from a stationery first RF port;

and second means comprising a plurality of stationary second ports, each of said second ports being discretely connected to a corresponding one of said stator loops.

2. Apparatus according to claim 1 in which said first means comprises an RF rotary joint mounted on said disc, an RF distribution network connecting said first RF port to said rotor loops, said network providing excitation of said rotor loops in said predetermined phase distribution pattern, said rotary joint being connected between said stationary RF port and said network.

3. Apparatus according to claim 2 in which said network includes a stripline of generally circular outline, said stripline comprising a pair of spaced, parallel, conductive planes, a dielectric medium therebetween and a plurality of center conductors emanating from the connection with said rotary joint, said center conductors including one conductor connected to each of said rotor loops, said conductors being suspended within and being supported by said dielectric medium.

4. Apparatus according to claim 3 in which said center conductors are each of a predetermined length to provide a discrete phase delay at each corresponding rotor loop consistent with said predetermined phase distribution.

5. Apparatus according to claim 1 in which said rotor loops have leg widths in planes parallel to said annulus and said disc small compared to the corresponding leg widths of said stator loops, thereby to cause said rotor assembly to have relatively low inertia.

6. Apparatus according to claim 1 in which said stator loops are circumferentially distributed over the full circle of said annulus and said rotor loops are circumferentially distributed over an arc of said disc less than 360 degrees.

7. Apparatus according to claim 6 in which said rotor loops are circumferentially distributed over an arc of said disc not exceeding 180 degrees.

8. Apparatus according to claim 3 in which said stripline has an outside diameter less than the inside diameter formed by the radially inward portions of said stator loops, one conductive plane of said stripline being extended to provide a conductive base which comprises one elongated current leg of said rotor loops, the other elongated current leg of each of said rotor loops being connected discretely to a corresponding one of said plurality of stripline center conductors.

9. Apparatus according to claim 1 in which said second ports are coaxial terminals and said stator loops connect discretely to said coaxial terminals, said stator loops substantially matching the characteristic impedance of said coaxial terminals.

10. Apparatus according to claim 1 in which the inside wall of said annulus cavity provides one conductive leg for each of said stator loops.

11. Apparatus according to claim 10 in which said rotor loops have leg widths in planes parallel to said annulus and said disc small compared to the corresponding leg widths of said stator loops, thereby to cause said rotor assembly to have relatively low inertia.

12. Apparatus according to claim 9 in which the inside wall of said annulus cavity provides one conductive leg for each of said stator loops.

* * * * *